United States Patent [19]

Cowling

[11] 4,016,819

[45] Apr. 12, 1977

[54] TABLE TROLLEY

[76] Inventor: Donald William Cowling, 14 Dover St., North Clayton, Victoria, Australia, 3168

[22] Filed: Aug. 6, 1975

[21] Appl. No.: 602,527

[30] Foreign Application Priority Data

Aug. 7, 1974 Australia ..... 8447/74
Oct. 16, 1974 Australia ..... 74420/74

[52] U.S. Cl. ..... 108/19; 108/132
[51] Int. Cl.[2] ..... A47B 3/02
[58] Field of Search ..... 108/19, 132, 131, 129

[56] References Cited

UNITED STATES PATENTS

| | | | |
|---|---|---|---|
| 1,861,305 | 5/1932 | Fasching | 108/19 |
| 2,508,627 | 5/1950 | Spiegel et al. | 108/19 |
| 3,818,844 | 6/1974 | Burr | 108/132 |

FOREIGN PATENTS OR APPLICATIONS

| | | | |
|---|---|---|---|
| 217,442 | 10/1958 | Australia | 108/132 |
| 1,041,643 | 10/1958 | Germany | 108/19 |
| 625,373 | 6/1949 | United Kingdom | 108/19 |

*Primary Examiner*—Ramon S. Britts
*Assistant Examiner*—Darrell Marquette
*Attorney, Agent, or Firm*—Andrus, Sceales, Starke & Sawall

[57] ABSTRACT

The invention provides a table comprising a first and a second set of legs and a table top; the table top being optionally supportable by either the first or the second set of legs and wherein the table top is pivotally attached to the second set of legs whereby, when supported by the second set of legs, the table top may be pivotable from a generally horizontal position to a generally vertical position.

It is preferred that the first set of legs is so mounted to the table top to demountably project therefrom. In one instance of this, the legs of the first set of legs are made detachable from the table top such as by being mounted to the table top by male and female threaded members. In another instance of this the legs of the first set of legs are pivotally attached to the table top and are movable from an erect position to a stowed position beneath the table top.

12 Claims, 15 Drawing Figures

TABLE TROLLEY

FIELD OF THE INVENTION

This invention relates to an improved table trolley.

In a particular aspect this invention relates to tables which are made easy to move about.

This invention has application both to existing tables and to tables to be newly manufactured.

Tables with foldable legs are well known and an example of such a table is a domestic billiard table which has a pair of legs at each end which are joined to one another and which can fold inwardly to beneath the table. However, such billiard tables are very heavy and, although the folding in of their legs makes them more compact for storage, the problem of moving them from place to place is unchanged.

Further, when the legs of such a table are folded and it is stood on a side edge of leaned against a wall, there is an ever present likelihood of warping of the playing surface of the table due to it not being flat against the wall.

Other tables, particularly billiard tables, are known which have legs which can be removed and by so doing the tables are made more compact but nevertheless are difficult to move from place to place and can warp when leaned against a wall.

Accordingly, the present invention seeks to at least in part overcome the above mentioned disadvantages.

SUMMARY OF THE INVENTION

The present invention provides a table comprising a first and a second set of legs and a table top; the table top being optionally supportable by either the first or the second set of legs and wherein the table top is pivotally attached to the second set of legs whereby, when supported by the second set of legs, the table top may be pivotable from a generally horizontal position to a generally vertical position.

PREFERRED FEATURES OF THE INVENTION

Most preferably, the second set of legs has wheels, castors or the like whereby the table may be moved about.

It is preferred that the first set of legs is so mounted to the table top to demountably project therefrom. In one instance of this, the legs of the first set of legs are made detachable from the table top such as by being mounted to the table top by male and female threaded members. In another instance of this the legs of the first set of legs are pivotally attached to the table top and are moveable from an erect position to a stowed position beneath the table top.

In the instance in which the legs of the first set of legs are made detachable from the table top it is preferred that the second set of legs is extendable and retractable so as to be able to be brought into and out of contact with the floor. It is also preferred that they are extendable to an extent as to raise the table top so as to transfer support thereof from the first to the second set of legs. This feature of extendability has further advantages in lifting heavy table tops and in enabling table tops, which otherwise would foul and floor or the second set of legs in pivotting from the generally horizontal to the generally vertical position, to be raised, before so pivotting, so that they will clear the floor or the second set of legs in so pivotting. This feature of extendability may be applied to the instance in which the legs of the first set of legs are foldable.

In a preferred construction where the legs of the first set of legs are foldable the parts are constructed and arranged so that the second set of legs acts as a stay for the first set of legs when in said erect position and supporting the table top in a generally horizontal position. It is preferred that lock means is provided whereby the first and second sets of legs can releasably lockingly engage when the first set of legs is in said erect position and supporting the table top in a generally horizontal position.

Means may be provided to releasably lock the table top in said generally vertical position.

DETAILED DESCRIPTION

Figure 1:
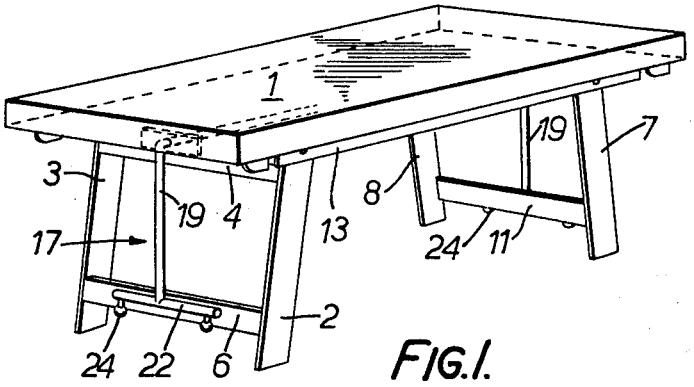
FIG. 1 is a perspective view of a first table in accordance with this invention.

The table shown in FIGS. 1–7 comprises a table top 1. This table top may be flat or may have a form suitable for the playing of billiards or other games thereon.

The table has a first set of legs which is constituted by legs 2 and 3 at one end which are joined by stretchers 4 and 6 and legs 7 and 8 at the other end which are joined by stretchers 9 and 11.

Legs 2 and 3 are pivotally attached by pins 12 to a table top support members 13 and legs 7 and 8 are attached by pins 12 to support members 13. By this attachment, the legs 2 and 3, and 7 and 8 are able to be swung from an erect position, shown in FIG. 1, in which they are stayed by table top support members 31, to a stowed position beneath the table top, shown in FIG. 3; in this respect it is to be noted that FIG. 2 shows the legs 2 and 3 (the leg 3 being obscured by leg 2) in an intermediate position. Leaf springs 16 serve to maintain the legs 2 and 3, and 7 and 8 in the erect and stowed positions by bearing against stretchers 4 and 9. In addition, releasable catch means (not shown) may be provided to retain the legs 2 and 3, and 7 and 8 in the stowed position.

The table additionally has a second set of legs which is indicated generally be reference numerals 17 and 18 and which is constituted by supports 19, cross-bars 22 and castors 24 which are carried by the cross-bars 22.

The supports 19 are secured to tubes 27 and 28 which extend through packing members 29 and the table top support members 31. At their inner ends the tubes 27 and 28 have tube 32 received therewithin (see FIG. 6) and pins 33 pass through tubes 27 and 28 into tube 32 to hold tubes 27 and 28 in fixed relation to one another.

Figure 7:
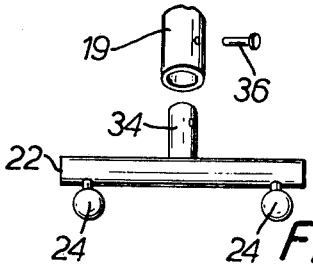
FIG. 7 is an exploded perspective view of part of the table shown in FIG. 1.
Figure 6:
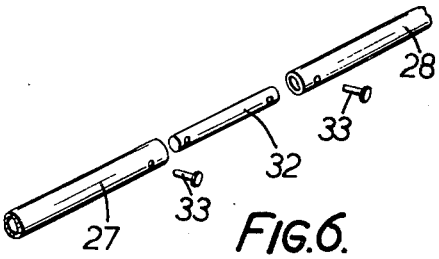
FIG. 6 is an exploded perspective view of part of the table shown in FIG. 1.

The cross-bars 22 are mounted to supports 19 by means of tubes 34 which are received therewithin and pins 36 pass through supports 19 into tubes 34 to secure them together; see FIG. 7.

Figure 2:
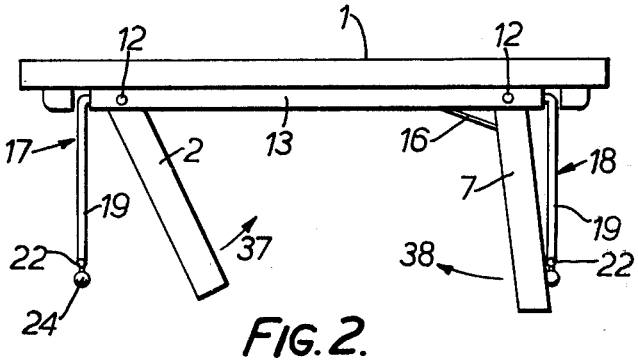
FIG. 2 is an elevation of the table shown in FIG. 1 showing it at a stage of erection.

As will be seen from FIG. 1, the table is capable of standing on legs 2 and 3, and 7 and 8 and in that position those legs are in part stayed by cross-bars 22 through supports 19.

Figure 3:
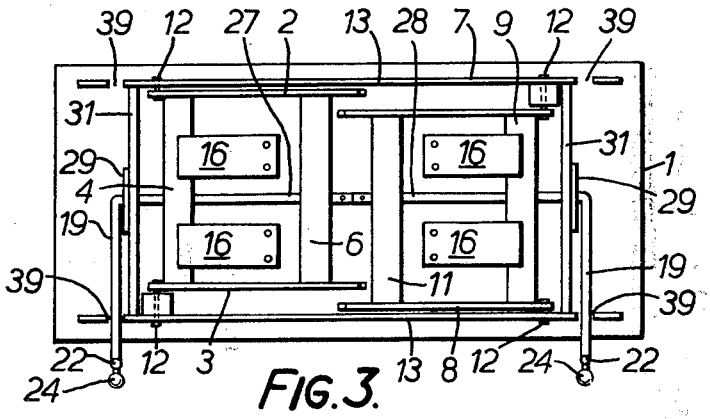
FIG. 3 is an elevation of the table shown in FIG. 1 showing it at another stage of erection.
Figure 4:
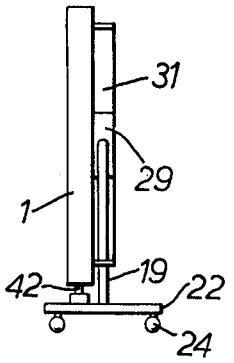
FIG. 4 is an end view of the table shown in FIG. 1 at the stage that it is at in FIG. 3.

When it is desired to move the table, the legs 2 and 3, and 7 and 8 are firstly swung to the stowed position as indicated by the arrows 37 and 38 in FIG. 1. After stowing to legs 2 and 3, and 7 and 8, the table is supported by the second set of legs 17 and 18. Thereafter, the table top 1 is pivoted (in either direction) about the axis defined by tubes 27 and 28 to take up a position as shown in FIGS. 3 and 4. The table may then be rolled to wherever desired.

Figure 5:
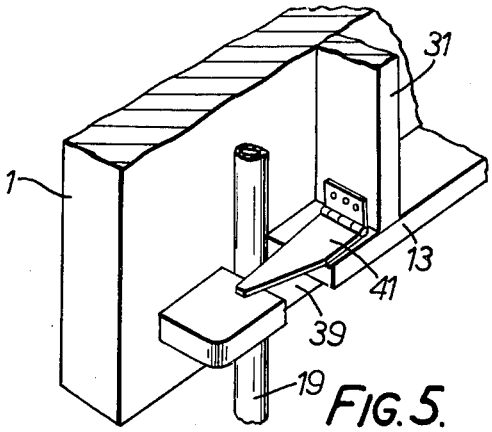
FIG. 5 is a perspective detail of the table shown in FIG. 1 at the stage that it is at in FIG. 3.

To enable the table top to take up the position shown in FIGS. 3 and 4 the support members 13 are slotted at 39 and to secure the table top in that position latch members 41 are provided (see FIG. 5). Alternative latch members may be provided to those shown in FIG. 5 and a particularly preferred latch member is one which engages supports 19 on the table top taking up the position shown in FIGS. 3 and 4.

To support the table top when in the position shown in FIGS. 3 and 4 the cross-bars 22 carry moveable studs 42 which may be screwed up or down as is required. In alternate constructions, the table top is supported by the cross-bars 22.

To convert existing tables to be as shown in FIGS. 1–7 it is only necessary to supply the second set of legs, packing members 29 and latch members 41 and, using those parts the conversion can be done with simple hand tools. In this respect it is to be noted that tubes 27, 28 and 32 and supports 19 and tubes 34 enable length and height adjustment to suit a particular table. Further, packing members 29 will compensate for any weakening of support members 31.

Figure 10:
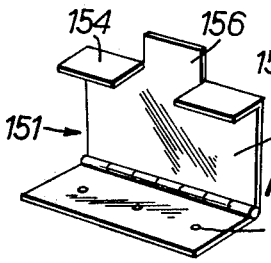
FIG. 10 is a perspective detail of part of the table shown in FIG. 8.
Figure 9:
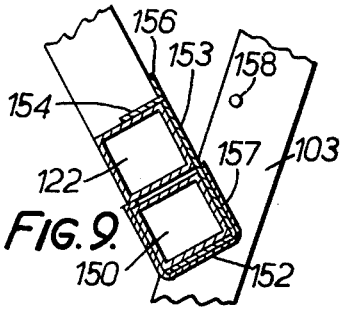
FIG. 9 is a cross-section view of part of the table shown in FIG. 8 in a particular condition.
Figure 8:
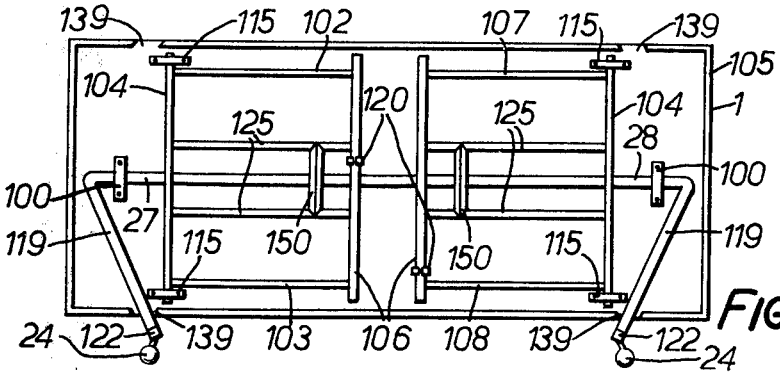
FIG. 8 is an elevation of a second table in accordance with this invention.

The table shown in FIG. 8, with details being shown in FIGS. 9 and 10, is similar to that shown in FIGS. 1–7 and like numerals denote like parts.

The following differences are, however, to be noted. Supports 119 extend at an angle to tubes 27 and 28, cross-bars 122 are of square-section tube, pivoting of table top 1 about tubes 27 and 28 is accomplished by means of brackets 100, the table top has a perimetric skirt 105 with cut-outs 139 therein to accommodate supports 119, legs 102 and 103, and 107 and 108 are joined at their lower ends by transverse floor rods 106 and at their upper ends by transverse pivot rods 104 which are pivotable in brackets 115, clip means 120 is provided for engaging the rods 106 to hold the legs 102 and 103, and 107 and 108 in stowed position, the rods 104 and 106 also support stay members 125 which are joined by cross-bars 150. The cross-bars 150 each have a hinge 151 attached thereto (see FIGS. 9 and 10). The hinges 151 comprise a first strap 152 which is attached to a cross-bar 150 and a second strap 153 which has flanges 154 and a grippable tab 156 thereon. The hinges 151 are biassed by springs 157.

In use, the hinges 151 and springs 157 serve as a means of releasably locking cross-bars 122 to cross-bars 150 as shown in FIG. 9; release being obtained by gripping and moving tabs 156. In this respect it is to be noted that cross-bars 122 will automatically engage with hinges 151 when legs 102 and 103, and 107 and 108 are appropriately swung on pivot rods 104 and a stop 158 is provided on stay member 125 to prevent excessive movement. Further, it is to be noted that in this embodiment the supports 119 serve as stays for legs 102 and 103, and 107 and 108. If desired an additional or alternative stay may be provided by the incorporation of a support member similarly positioned as support member 31 in FIGS. 1–7.

The table shown in FIG. 8 can be used in a similar manner to that shown in FIGS. 1–7.

Figure 11:
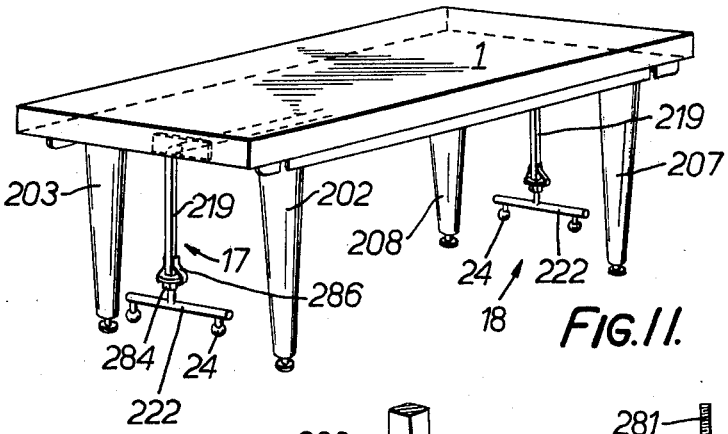
FIG. 11 is a perspective view of a third table in accordance with this invention and shows it in a stage of erection.
Figure 12:
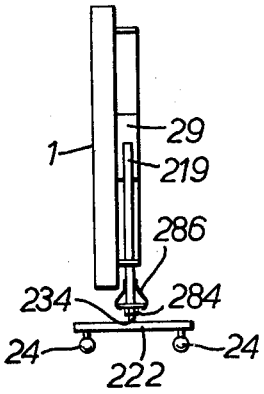
FIG. 12 is an end elevation of the table shown in FIG. 11 and shows it in a different stage of erection.
Figure 13:
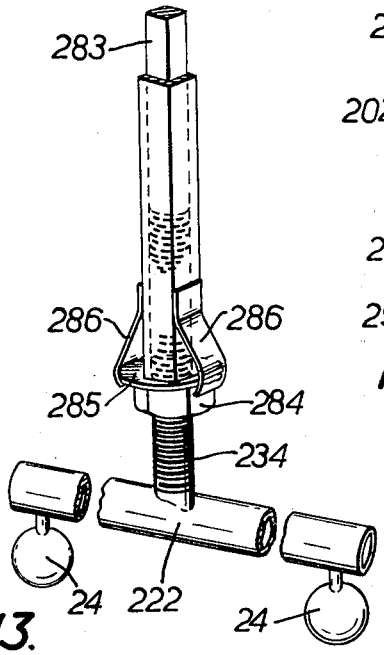
FIG. 13 is a detail of part of the table shown in FIG. 11.
Figure 15:
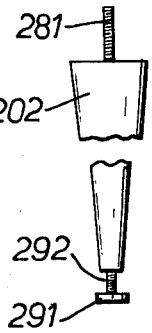
FIG. 15 is a side elevation of one leg of the table shown in FIG. 11.

The table shown in FIGS. 11–13 is similar to that shown in FIGS. 1–7 and like numerals denote like parts.

The following differences are, however, to be noted. The table has a first set of legs 202, 203, 207 and 208 which each have male screw means 281 at their upper ends 182 which can be screwed into mounts 282 provided with female threaded means which are secured beneath the table top 1. Thus, the legs 202, 203, 207 and 208 are made detachable from the table top.

The second set of legs indicated generally by 17 and 18 include supports 219 of square cross-section tube and crossbars 222 are mounted thereto by means of male threaded members 234 which are secured to the crossbars 222 at one end and which have square section rods 283 at their other ends which make the cross-bars 222 non-rotatable with respect to the supports 219. Fitted to the male threaded members 234 is a nut 284 provided with a flange 285. The flange 285 is engaged on its underside by lugs 286 which will prevent the cross-bars 222 from falling with respect to the supports 219 when the cross-bars 222 are otherwise unsupported. By rotating the nut 284 the spacing of the cross-bars 222 and the supports 219 will be varied.

The legs 202, 203, 207 and 208 have plates 291 mounted on screws 292 which can be screwed into the out of the bottoms of the legs so as to give fine adjustment of the height of the table top 1 and to adjust the level thereof In use, the table shown in FIGS. 11–14 will normally be supported on the legs 202, 203, 207 and 208 as shown in FIG. 11.

However, when desired, the nuts 204 may be turned in the appropriate direction to advance the cross-bars 222 toward the floor until the table top 1 is lifted off the legs 202, 203, 207 and 208. In this condition, the table may be moved about on the castors 24 while the table top 1 remains horizontal.

Figure 14:
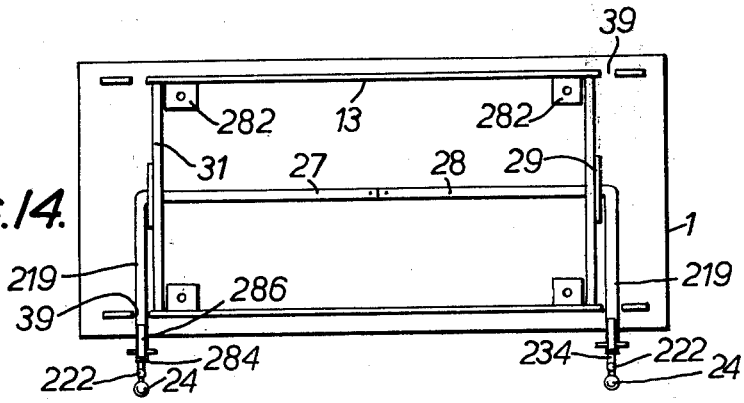
FIG. 14 is a side elevation of the table shown in FIG. 11 and shows it in the stage of erection shown in FIG. 12.

Alternatively, the screw means 201 can be unscrewed from the mounts 282 so that the legs 202, 203, 207 and 208 become detached from the table top and thereafter the table top 1 may be pivoted to be generally vertical as shown in FIGS. 12 and 14 in similar manner to the table described with respect to FIGS. 1–7. In this condition the table may be moved about on the castors 24. It is further to be noted that adjustment of the nuts 284 will enable the table top 1 to be supported on the cross-bars 222. In the condition shown in FIGS. 12 and 14 the legs 202, 203, 207 and 208 may be strapped to the underside of the table top 1, may be clipped thereto by means not shown or may be retained separate.

This invention, as stated, is applicable to the conversion of existing tables as well as to the manufacture of new tables and has the particular advantage that a table in accordance therewith is easily erected or stored. The invention will find particular application to billiard tables but will also be applicable to hobby tables, catering tables and tables for use in schools.

The table shown in FIGS. 11–14 is desirably a heavy table or one wherein half the width measured transverse to the axis of pivoting is such that without the extendability of the cross-bars 222 relative to the supports 219 there would be insufficient space between the axis of pivoting and the cross-bars 222 to accommodate the table top.

In a modification, tubes 27 and 28 are located offset from the central longitudinal axis of the table top.

In a modification of the table shown in FIGS. 11–14 the legs 202, 203, 207 and 208 are releasably bolted to the table top and in another modification the nuts 284 have wings to facilitate turning.

Modifications and adaptions may be made to the constructions disclosed above without departing from the spirit and scope of this invention which includes every novel feature and combination of features disclosed herein. The following claims form part of the disclosure of this specification.

I claim:

1. A table comprising:

a table top having opposite sides and opposite ends;

a first set of legs having a pair of leg members generally located at opposite ends of the table for supporting said table top in a generally horizontal position, each pair of leg members being located along a line extending between said sides of the table top; and a second set of legs having a pair of leg members generally located at opposite ends of said table, said table top being pivotally attached to said second set of legs along an axis extending between said ends of the table top generally perpendicular to said lines for movement from said generally horizontal position to a position in which said table top is generally vertical when said table top is supported by said second set of legs, said first set of legs being displaceably coupled to said table top for facilitating pivotal movement of said table top.

2. A table as claimed in claim 1, wherein the first set of legs is so mounted to the table top to demountably project therefrom.

3. A table top as claimed in claim 2, wherein the legs of the first set of legs are detachably mounted to the table top.

4. A table top as claimed in claim 1, wherein the legs of the first set of legs are detachably mounted to the table top and wherein the second set of legs is extendable and retractable with respect to the table top.

5. A table as claimed in claim 1, wherein the legs of the first set of legs are pivotally attached to the table top and are moveable from an erect position for supporting said table top to a stowed position beneath the table top.

6. A table as claimed in claim 1, wherein the second set of legs is provided with wheels, castors or the like.

7. A table as claimed in claim 1, wherein the legs of the first set of legs are pivotally attached to the table top and are movable from an erect position for supporting said table top to a stowed position beneath the table top, said sets of legs being constructed and arranged for bracing the first set of legs with the second set of legs when in said erect position and supporting the table top in a generally horizontal position.

8. A table as claimed in claim 7 including lock means for releasably lockingly engaging said first and second set of legs when the first set of legs is in said erect position and supporting the table top in a generally horizontal position.

9. A table as claimed in claim 1, wherein means is provided to releasably lock the table top in said generally vertical position.

10. A table as claimed in claim 1, wherein said second set of legs comprises two vertical posts which are disposed at said opposite ends of the table top; the posts having laterally extending members at their bottoms capable of supporting the posts, said table top being pivotally attached to the top of the posts.

11. A table as claimed in claim 1 wherein said second set of legs is so constructed and arranged as to be pivotal to a stowed position beneath the table top when said table top is supported by said first set of legs.

12. A table as claimed in claim 6 wherein said second set of legs forms a trolley for supporting said table top.

* * * * *